US009132356B2

(12) United States Patent
Giordano

(10) Patent No.: US 9,132,356 B2
(45) Date of Patent: Sep. 15, 2015

(54) SWING SYSTEM AND METHOD OF USE

(71) Applicant: Jeno Giordano, Lake Charles, LA (US)

(72) Inventor: Jeno Giordano, Lake Charles, LA (US)

( * ) Notice: Subject to any disclaimer, the term of this patent is extended or adjusted under 35 U.S.C. 154(b) by 22 days.

(21) Appl. No.: 13/925,819

(22) Filed: Jun. 24, 2013

(65) Prior Publication Data

US 2014/0274430 A1 Sep. 18, 2014

Related U.S. Application Data

(60) Provisional application No. 61/622,920, filed on Jun. 22, 2012, provisional application No. 61/788,166, filed on Mar. 15, 2013.

(51) Int. Cl.
*A63G 9/00* (2006.01)
*A63G 13/00* (2006.01)

(52) U.S. Cl.
CPC ..... *A63G 9/00* (2013.01)

(58) Field of Classification Search
CPC ..... A63G 9/00; A63G 9/02; A63G 9/12; A63G 9/14; A63G 13/00; A63G 13/08; A47C 3/0255
USPC ..... 472/118, 125; 482/24, 33, 35, 91, 95, 482/96
See application file for complete search history.

(56) References Cited

U.S. PATENT DOCUMENTS

| | | | | |
|---|---|---|---|---|
| 4,084,812 | A * | 4/1978 | Melrose et al. | 472/118 |
| 6,726,606 | B2 * | 4/2004 | Jacobsen | 482/121 |
| 7,780,573 | B1 | 8/2010 | Carmein | |
| 8,007,413 | B1 | 8/2011 | Wu | |
| 8,038,584 | B1 | 10/2011 | Pruessner et al. | |
| 8,083,653 | B2 * | 12/2011 | Hetrick | 482/91 |
| D654,124 | S | 2/2012 | Davis | |
| 8,197,392 | B2 * | 6/2012 | Silverman et al. | 482/91 |

OTHER PUBLICATIONS http://www.bing.com/images/search?q=omni+gym&view=detail&id=FD7B3F9C8B65B5FA55030DCF407A0785E4E1A05A&first=0&FORM=IDFRIR.
http://www.gettrufit.com/blog/ <http://www.gettrufit.com/blog/>.

* cited by examiner

*Primary Examiner* — Kien Nguyen
(74) *Attorney, Agent, or Firm* — Shannon L Warren, J.D.

(57) ABSTRACT

A swing systems is disclosed. Said swing system comprising a pod, a two or more pod hangers and a two or more hanger strap sets. Said pod comprising a one or more vertical portions and a one or more horizontal portions. Said two or more pod hangers attached to said one or more horizontal portions of said pod. Said two or more pod hangers comprising at least a first hanger and a second hanger. Said two or more hanger strap sets attached to a two of said two or more pod hangers. A one of said two or more hanger strap sets comprises A leg strap assembly having a first end and a handle loop at a second end, and An arm strap assembly having a first end and a handle loop at a second end.

19 Claims, 17 Drawing Sheets

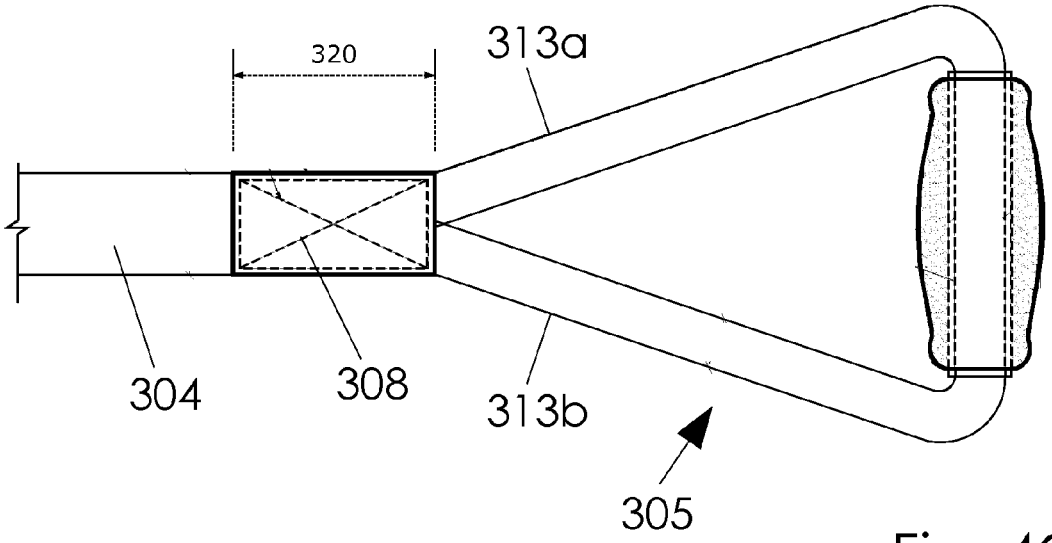
Fig. 4C
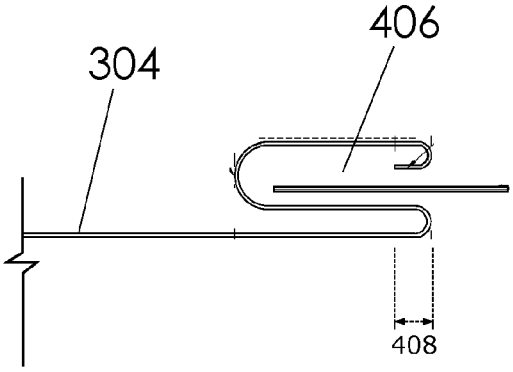
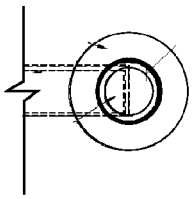
Fig. 4D
Fig. 4E

SWING SYSTEM AND METHOD OF USE

BACKGROUND

This application, filed on Monday, Jun. 24, 2013 is filed within a statutory year of and claims reference to U.S. Patent Application No. 61/662,920 filed on Jun. 22, 2012, and U.S. Patent Application No. 61/788,166 filed on Mar. 15, 2013.

This disclosure relates generally to a swing system and method of use. None of the prior art, taken either singularly or in combination, is seen to describe the instant disclosure as claimed. Accordingly, an improved swing system and method of use would be advantageous.

SUMMARY

A first swing system is disclosed comprising a pod, two or more pod hangers, and a tow or more hanger strap sets attached to a two of said two or more pod hangers.

Said pod comprising a one or more vertical portions and a one or more horizontal portions. Said two or more pod hangers attached to said one or more horizontal portions of said pod. Said two or more pod hangers comprising at least a first hanger and a second hanger. Said two or more hanger strap sets attached to a two of said two or more pod hangers. Said one of said two or more hanger strap sets comprising a hanger strap having a first end and a second end, a leg strap assembly having a first end and a handle loop at a second end, an arm strap assembly having a first end and a handle loop at a second end, a rigger at a first end of said hanger strap capable of releaseably attaching to one of said two or more pod hangers, said first end of said leg strap assembly attaches to said hanger strap and said first end of said arm strap assembly attaches to said hanger strap. Said leg straps assemblies having a length. Said arm strap assemblies having a length. Said length of said leg strap assemblies being greater than said length of said arm strap assemblies. Said hanger strap comprise a one or more pockets arranged between its said first end and said second end. Said leg strap assemblies and said arm strap assemblies each comprising an attachment assembly at their first end. Said leg strap assemblies and said arm strap assemblies are capable of adjustably attaching to said two or more hanger straps by selectively attaching a one of said arm strap assemblies to one of said one or more pockets with said attachment assembly of said arm strap assemblies and a one of said leg strap assemblies to one of said one or more pockets with said attachment assembly of said leg strap assemblies.

A second swing system is disclosed comprising a pod, a two or more pod hangers and a two or more hanger strap sets. Said pod comprising a one or more vertical portions and a one or more horizontal portions. Said two or more pod hangers attached to said one or more horizontal portions of said pod. Said two or more pod hangers comprising at least a first hanger and a second hanger. Said two or more hanger strap sets attached to a two of said two or more pod hangers. A one of said two or more hanger strap sets comprises A leg strap assembly having a first end and a handle loop at a second end, and An arm strap assembly having a first end and a handle loop at a second end.

A method of using a swing system is disclosed comprising: attaching a hanger strap set to a two of a two or more pod hangers of a pod; inserting a one or more feet of a user into a one or more leg straps of said hanger strap sets; inserting a one or more hands of said user into a one or more arm straps of said hanger strap sets; supporting a weight of said user with said pod by suspending a portion of said weight of said user from a one or more horizontal portions of said pod, attaching said one or more horizontal portions of said pod to a first end of a one or more vertical portions of said pod, and attaching a second end of a one or more vertical portions of said pod to a ground surface below said user of said pod; and swinging said user in said hanger strap set.

BRIEF DESCRIPTION OF THE DRAWINGS

FIGS. 4C, 4D and 4E illustrate an elevated top view and two side views of said foot strap assembly and said bottom stitch.

DETAILED DESCRIPTION

Described herein is a swing system and method of use. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
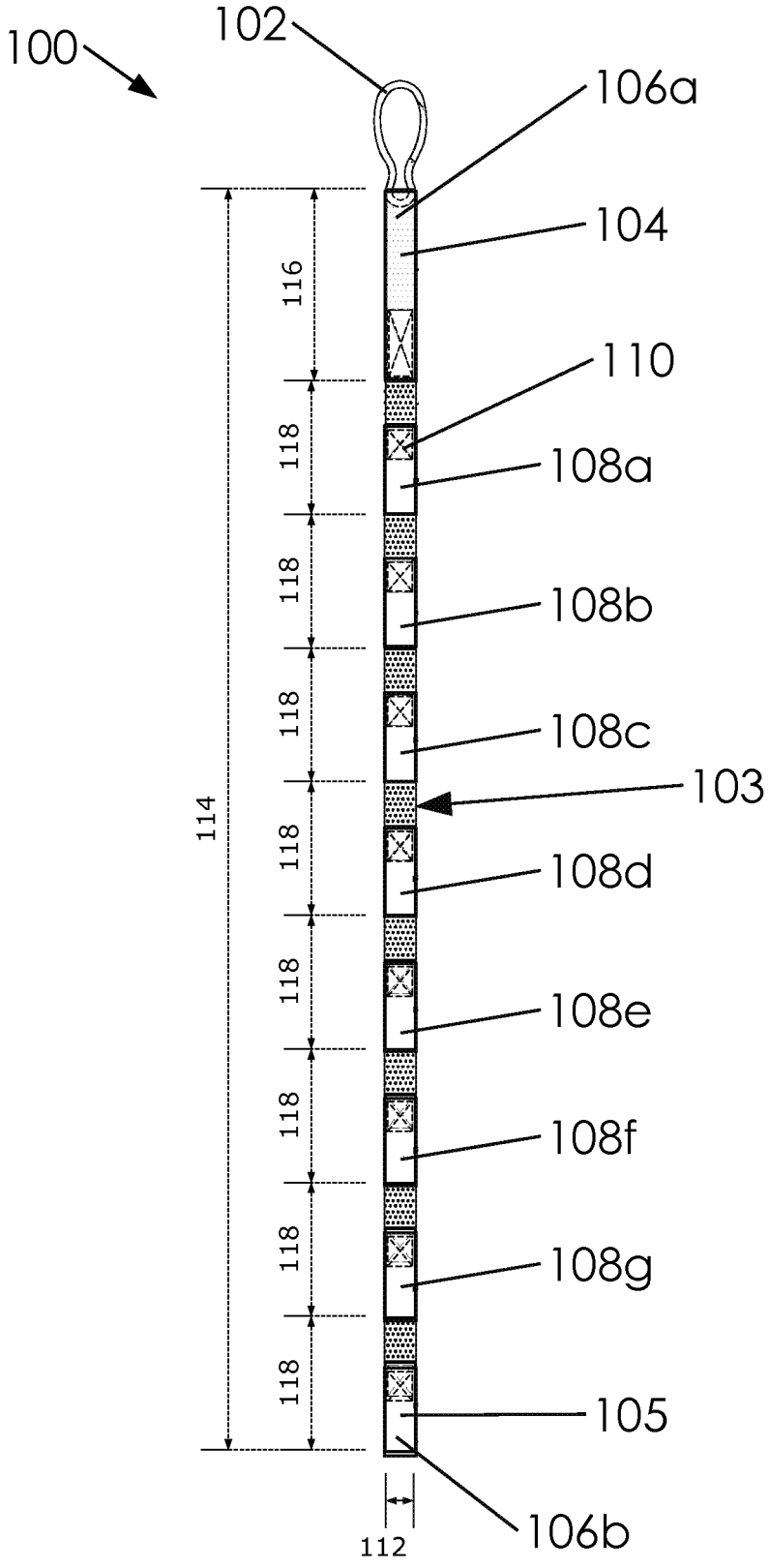
FIG. 1 illustrates an elevated front view of a hanger strap.

FIG. 1 illustrates an elevated front view of a hanger strap 100. In one embodiment, said swing system and method of use can comprise a swing system 101 (illustrated infra). In one embodiment, said swing system 101 can comprise said hanger strap 100. In one embodiment, said hanger strap 100 can comprise a rigger 102 and a strap portion 103. In one embodiment, said strap portion 103 can comprise a first webbing eye 104, a second webbing eye 105, a first end 106*a* and a second end 106*b*. In one embodiment, said first webbing eye 104 can be at said first end 106*a*, and said second webbing eye 105 can be at said second end 106*b*. In one embodiment, one or more pockets can attach along the length of on said strap portion 103. In one embodiment, said one or more pockets can comprise a first pocket 108*a*, a second pocket 108*b*, a third pocket 108*c*, a fourth pocket 108*d*, a fifth pocket 108*e*, a sixth pocket 108*f*, and a seventh pocket 108*g*. In one embodiment, more or less pockets may be used for a custom length and fit.

In one embodiment, said one or more pockets can attach to said strap portion 103 with a cross stitch pattern 110. In one embodiment, one or more pockets can be fastened with another type of stitching or via a canvas fastener. In one embodiment, said strap portion 103 can comprise a width 112 and a length 114. In one embodiment, said first webbing eye 104 can comprise a length 116. In one embodiment, each of said one or more pockets can be separated by a length 118. In one embodiment, each of said cross stitch pattern 110 of said one or more pockets can be separated by said length 118. In one embodiment, each of said one or more pockets can be a different color from one another. In one embodiment, said rigger 102 can be made by a wide range of manufacturers and therefore be a variety of different designs. In one embodiment, said length 118 can be 6". In one embodiment, said length 114 can be 4' 8.5". In one embodiment, width 112 can be 1.5".

Figure 2A:
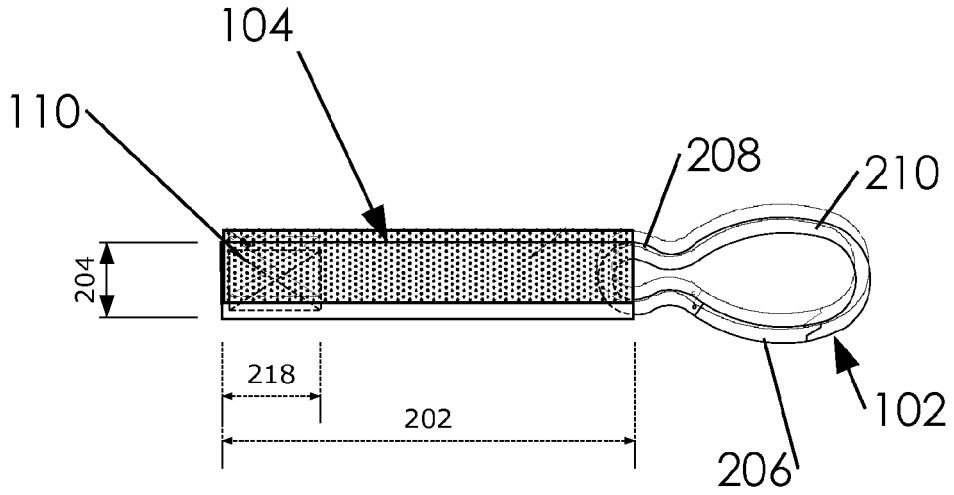
FIGS. 2A and 2B illustrate an elevated top view and side view of said first webbing eye and said rigger.
Figure 2B:
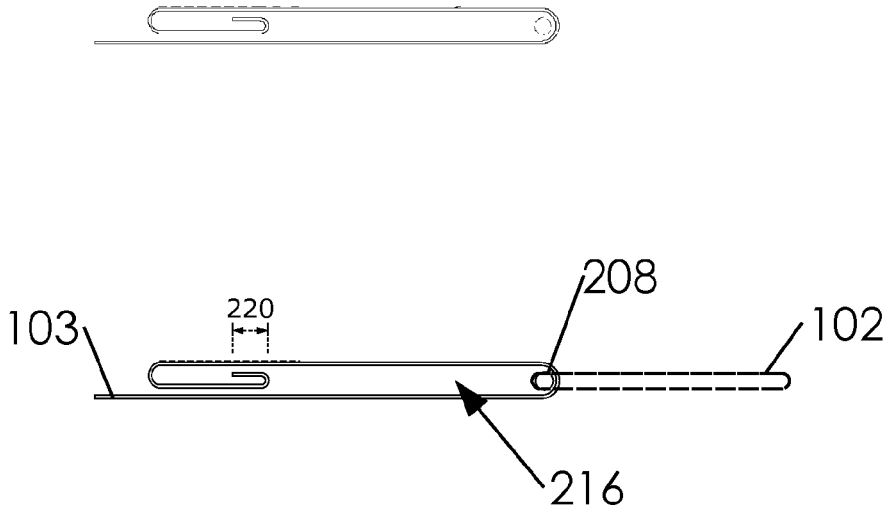

FIGS. 2A and 2B illustrate an elevated top view and side view of said first webbing eye 104 and said rigger 102. In one embodiment, said first webbing eye 104 can comprise a length 202 and a width 204. In one embodiment, said rigger 102 can comprise a type of carabineer (such as rock climbing carabiner) having a substantially loop shaped body and a sprung gate 206. In one embodiment, said rigger 102 can comprise a neck 208 and an open portion 210. In one embodiment, said sprung gate 206 can be a part of said open portion 210. In one embodiment, said neck 208 can attach to said first webbing eye 104. In one embodiment, a webbing eye 216 in said first webbing eye 104 can be formed by sewing a portion of said strap portion 103 into a loop with one of said cross stitch pattern 110. In one embodiment, said cross stitch pattern 110 can comprise a length 218. In one embodiment, said first webbing eye 104 can comprise a portion of said strap portion 103 at said first end 106*a*. In one embodiment, forming said webbing eye 216 can comprise: folding said first end 106*a* a first length 220; folding said first end 106*a* again by then said length 218; folding said first end 106*a* again by said length 202; and attaching said first end 106*a* to a portion of said strap portion 103. In one embodiment, attaching said first end 106*a* to said portion of said strap portion 103 can comprise sewing through one or more layers of said strap portion 103 with one of said cross stitch pattern 110. In one embodiment, said first length 220 can comprise ½"; said length 218 can comprise 2½"; and said length 202 can comprise 8½". In one embodiment, said width 204 can comprise 1½". In one embodiment, said first webbing eye 104 can comprise polyester webbing.

Figure 2C:
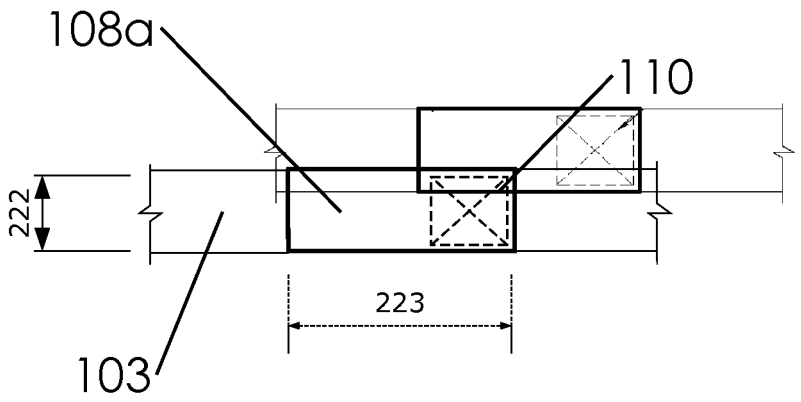
FIGS. 2C and 2D illustrate an elevated top view and an elevated side view of said first pocket.
Figure 2D:
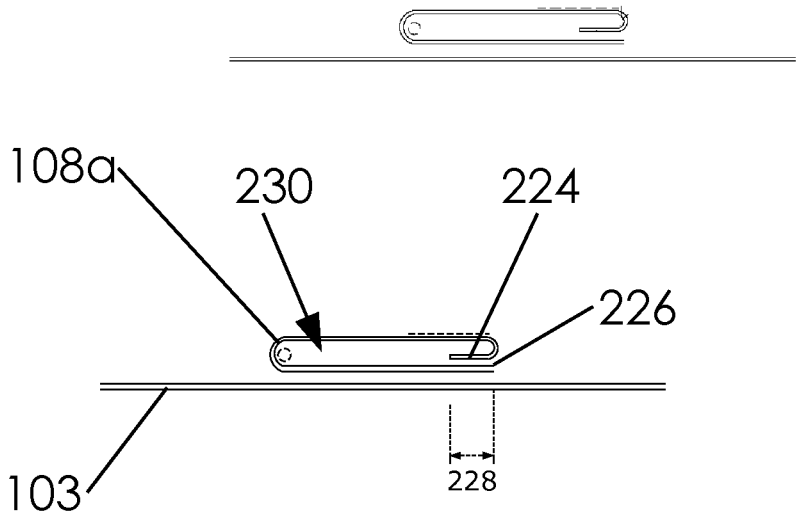

FIGS. 2C and 2D illustrate an elevated top view and an elevated side view of said first pocket 108*a*. In one embodiment, said first pocket 108*a* can be exemplary of all of said one or more pockets. In another embodiment, said one or more pockets can each have a different design. In one embodiment, said first pocket 108*a* can comprise a width 222 and a length 223. In one embodiment, said one or more pockets can each be attached to said strap portion 103 with one of said cross stitch pattern 110. In one embodiment, said first pocket 108*a* can comprise a strap having a first end 224 and a second end 226. In one embodiment, attaching each of said one or more pockets to said strap portion 103 can comprise: folding said first end 224 to a length 228; folding said first end 224 again to said length 223; pressing said first end 224 against said second end 226; and securing said first end 224 and said second end 226 to said strap portion 103. In one embodiment, securing said first end 224 and said second end 226 to said strap portion 103 can comprise sewing each together with one of said cross stitch pattern 110. In one embodiment, said second end 226 can overlap and extend beyond said cross stitch pattern 110. In one embodiment, each of said one or more pockets can comprise a substantially loop shape attached to said strap portion 103, each comprising a pocket eye 230.

Figure 2E:
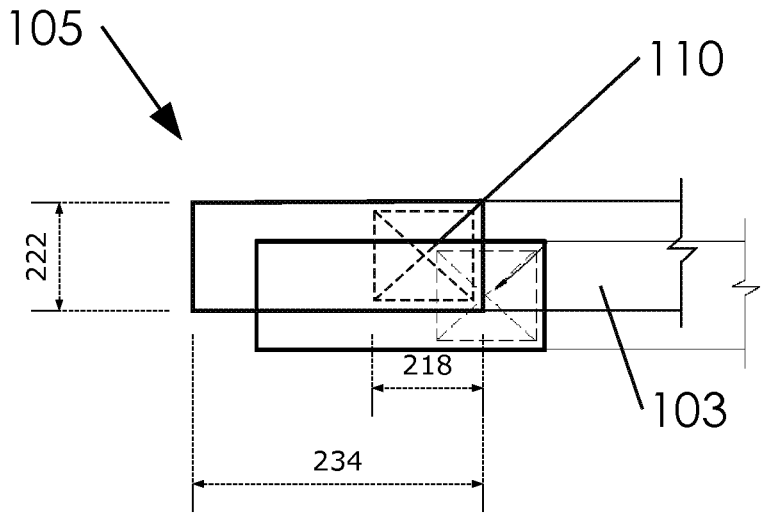
FIGS. 2E and 2F illustrate an elevated top view and side view of said second webbing eye.
Figure 2F:
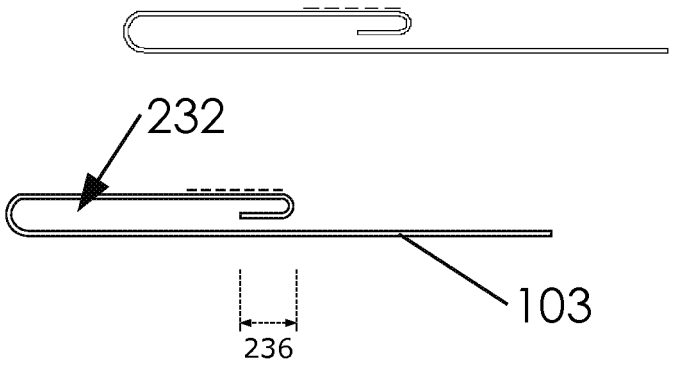

FIGS. 2E and 2F illustrate an elevated top view and side view of said second webbing eye 105. In one embodiment, said second webbing eye 105 can comprise a loop shape at said second end 106*b* of said strap portion 103. In one embodiment, said second webbing eye 105 can comprise a webbing eye 232 inside of said loop shape. In one embodiment, said webbing eye 232 can be substantially similar to said pocket eye 230. In one embodiment, said webbing eye 232 can comprise a length 234. In one embodiment, forming said second webbing eye 105 can comprise: folding said second end 106*b* to a length 236; folding said second end 106*b* again to said length 234; attaching said second end 106*b* to said strap portion 103; wherein, attaching said second end 106*b* to said strap portion 103 can comprise sewing them together with one of said cross stitch pattern 110.

Figure 3A:
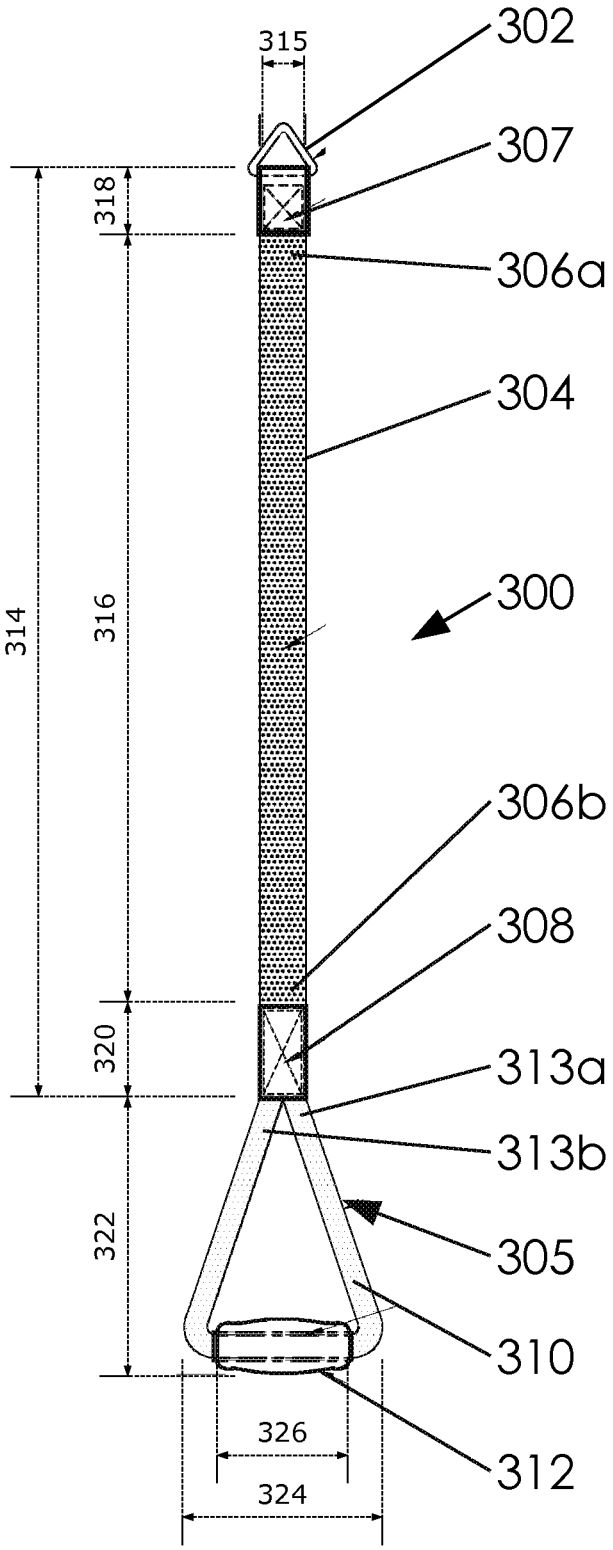
FIGS. 3A and 3B illustrate an elevated overview of a leg strap assembly and an attachment assembly.
Figure 3B:
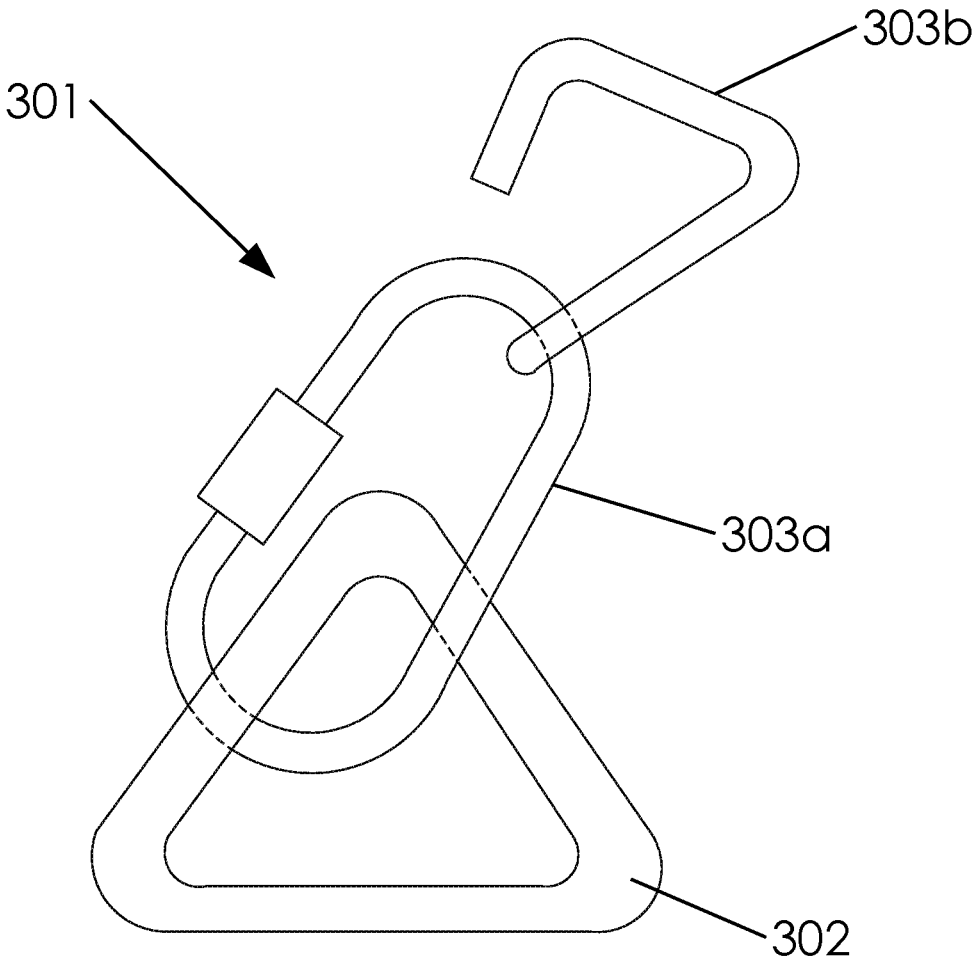

FIGS. 3A and 3B illustrate an elevated overview of a leg strap assembly 300 and an attachment assembly 301. In one embodiment, said leg strap assembly 300 can comprise a triangle loop 302, a webbing strap 304, and a foot strap assembly 305. In one embodiment, said attachment assembly 301 can comprise a quick release 303*a* and a hook 303*b*. In one embodiment, said webbing strap 304 can comprise a first end 306*a* and a second end 306*b*. In one embodiment, said triangle loop 302 can attach to said first end 306*a* with a top stitch 307. In one embodiment, said foot strap assembly 305 can attach to said second end 306*b* with a bottom stitch 308. In one embodiment, said triangle loop 302 can comprise a metallic material such as a nickel plated metal. In one embodiment, said triangle loop 302 can comprise ¼" diameter rounded material. In one embodiment, said triangle loop 302 can comprise a triangular shape. In one embodiment, said quick release 303*a* can attach said triangle loop 302 to said hook 303*b*. In one embodiment, said hook 303*b* can attach to one of said one or more pockets on said hanger strap 100. In one embodiment, said hook 303*b* can comprise a quick connecting hook. In another embodiment, said hook 303*b* can comprise a zinc material. In one embodiment, said hook 303*b* can attach to one or more of said one or more pockets in a rapid manner (as opposed to said quick release 303*a*), since said hook 330*b* does not need to open and close in order to hook into said one or more of said one or more pockets. In one embodiment, said foot strap assembly 305 can comprise a webbing portion 310 and a foot grip 312. In one embodiment, said leg strap assembly 300 can comprise a handle loop comprising said foot strap assembly 305, said webbing portion 310, said bottom stitch 308, and said foot grip 312. In one embodiment, said webbing portion 310 can comprise a first end 313*a* and a second end 313*b*. In one embodiment, said webbing portion 310 can comprise a loop shape with both said first end 313*a* and said second end 313*b* attached to said bottom stitch 308. In one embodiment, said foot grip 312 can comprise a cylindrical shaped object wrapped around a portion of said webbing portion 310. In one embodiment, said foot grip 312 can comprise a piece of PVC pipe comprising a hollow center with a portion of said webbing portion 310 threaded through said hollow center. In one embodiment, said foot grip 312 can comprise a soft material on an exterior surface able to aid in the process of gripping said foot grip 312. In one embodiment, said webbing portion 310 and said webbing strap 304 can comprise a polyester webbing. In one embodiment, said webbing strap 304 can comprise a length 314 and a width 315. In one embodiment, a distance between said top stitch 307 and said bottom stitch 308 can comprise a length 316. In one embodiment, said top stitch 307 can comprise a length 318 and said bottom stitch 308 can comprise a length 320. In one embodiment, said foot strap assembly 305 can comprise a length 322 and a width 324. In one embodiment, said foot grip 312 can comprise a width 326.

Figure 4A:
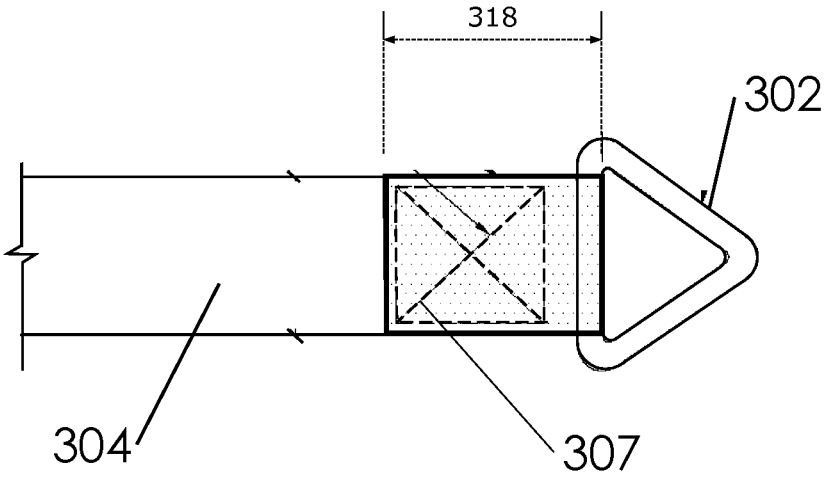
FIGS. 4A and 4B illustrate an elevated top view and side view of said top stitch with said triangle loop.
Figure 4B:
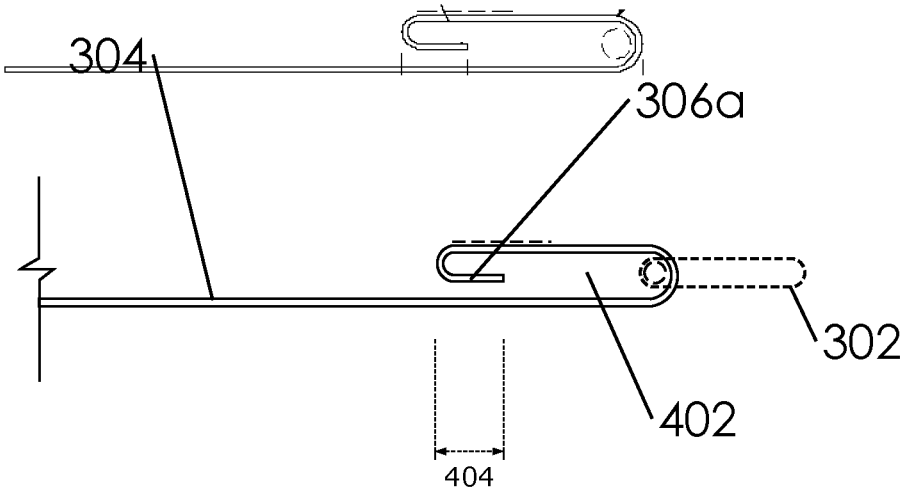

FIGS. 4A and 4B illustrate an elevated top view and side view of said top stitch 307 with said triangle loop 302. In one embodiment, said top stitch 307 can comprise a webbing eye 402. In one embodiment, forming said webbing eye 402 can comprise: folding said first end 306*a* to a length 404; folding said first end 306*a* again to said length 318; and attaching said first end 306*a* to a portion of said webbing strap 304 with said top stitch 307. In one embodiment, a portion of said triangle loop 302 can be held within said webbing eye 402.

FIGS. 4C, 4D and 4E illustrate an elevated top view and two side views of said foot strap assembly 305 and said bottom stitch 308. In one embodiment, said bottom stitch 308 can comprise a webbing eye 406. In one embodiment, forming said webbing eye 406 can comprise: folding said second end 306*b* to a length 408; folding said second end 306*b* again to said length 320; inserting said first end 313*a* and said second end 313*b* into folded said second end 306*b*; and attaching said second end 306*b* to a portion of said webbing strap 304 with said bottom stitch 308.

Figure 5:
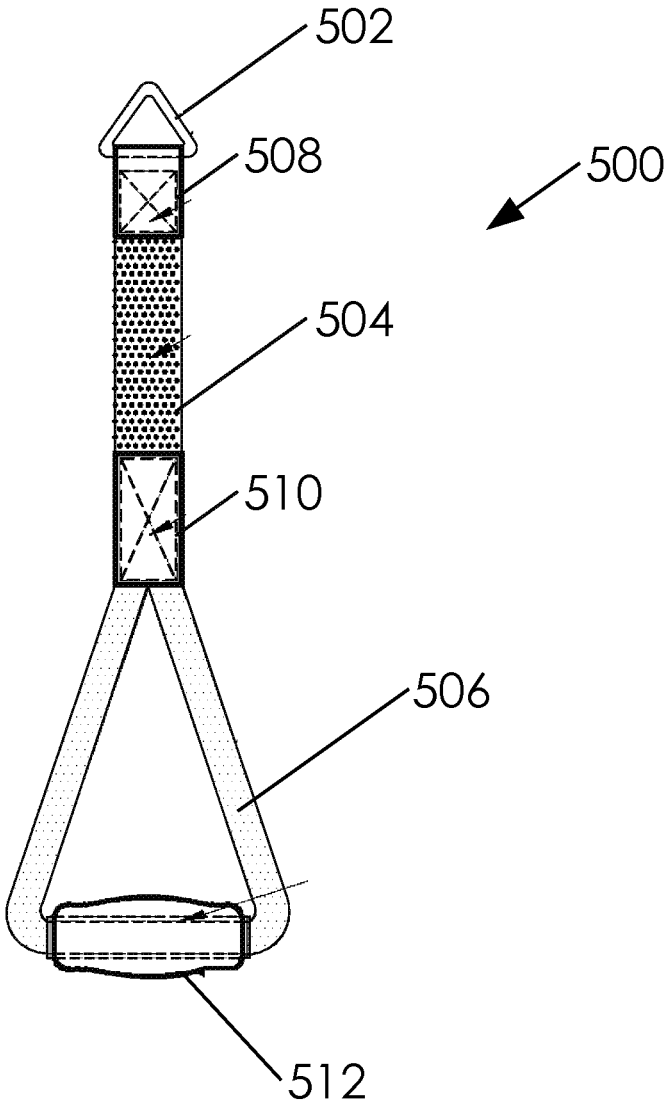
FIG. 5 illustrates an elevated overview of an arm strap assembly.

FIG. 5 illustrates an elevated overview of an arm strap assembly 500. In one embodiment, said arm strap assembly 500 can comprise a triangle loop 502, a webbing strap 504, a webbing portion 506, a top stitch 508, a bottom stitch 510, and a hand grip 512. In one embodiment, said arm strap assembly 500 can comprise a handle loop comprising said webbing portion 506, said bottom stitch 510 and said hand grip 512. In one embodiment, said arm strap assembly 500 can be formed similarly to said leg strap assembly 300 however said webbing strap 504 can be the same or shorter than said webbing strap 304. In one embodiment, said attachment assembly 301 can be used to attach said triangle loop 502 to one of said one or more pockets of said hanger strap 100.

Figure 6A:
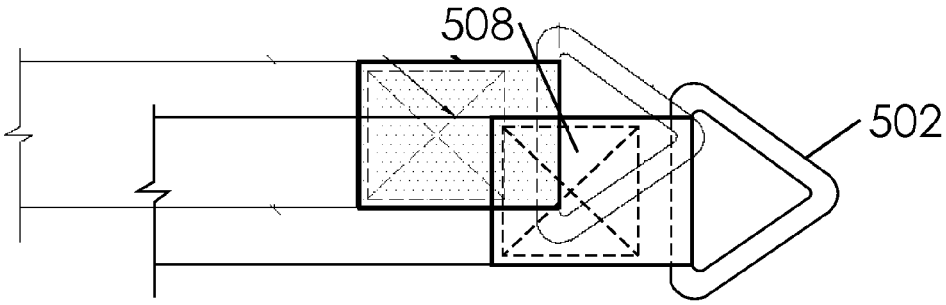
FIGS. 6A and 6B illustrate an elevated top view and side view of said triangle loop and said top stitch.
Figure 6B:
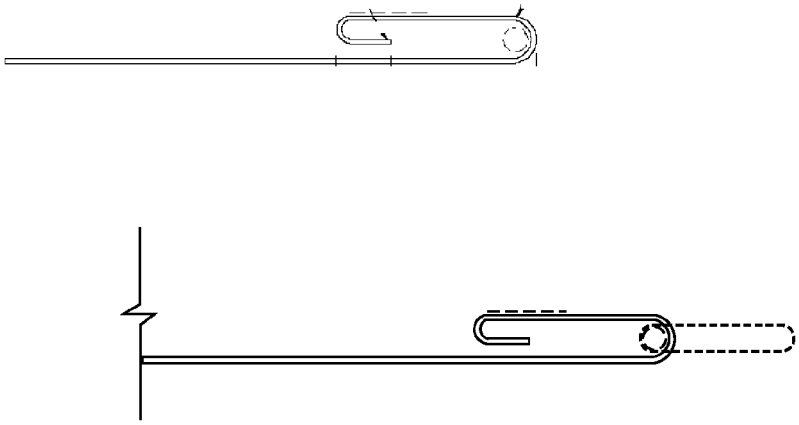

FIGS. 6A and 6B illustrate an elevated top view and side view of said triangle loop 502 and said top stitch 508. In one embodiment, said triangle loop 502 and said top stitch 508 can be formed similarly to said triangle loop 302 and top stitch 307.

Figure 6C:
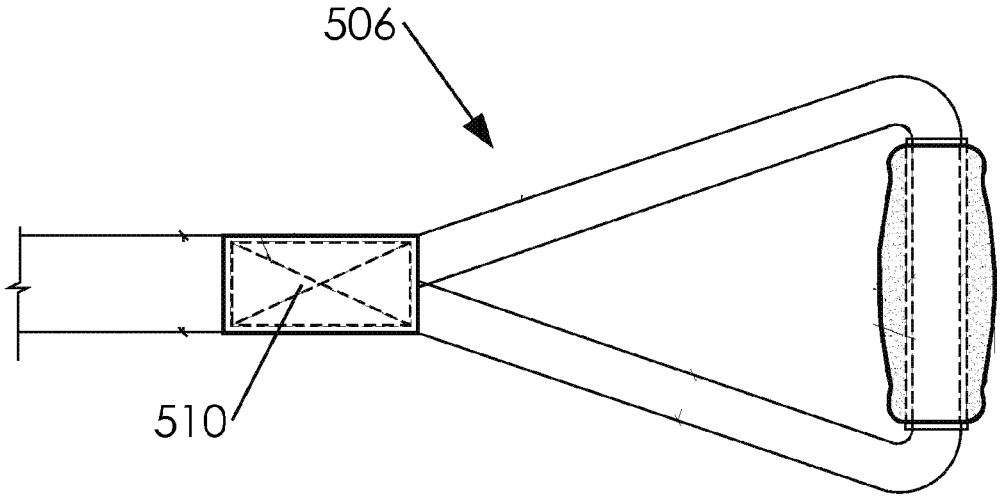
FIGS. 6C, 6D and 6E illustrate an elevated top view and two side views of said arm grip and said bottom stitch.
Figure 6D:
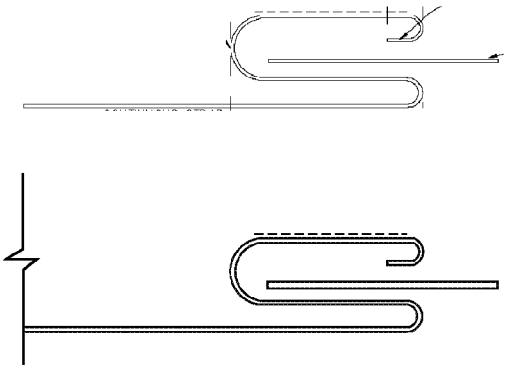
Figure 6E:
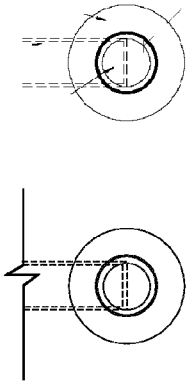

FIGS. 6C, 6D and 6E illustrate an elevated top view and two side views of said arm grip 506 and said bottom stitch 510. In one embodiment, said arm grip 506 and said bottom stitch 510 can be formed similarly to said foot strap assembly 305 and said bottom stitch 308.

Figure 7A:
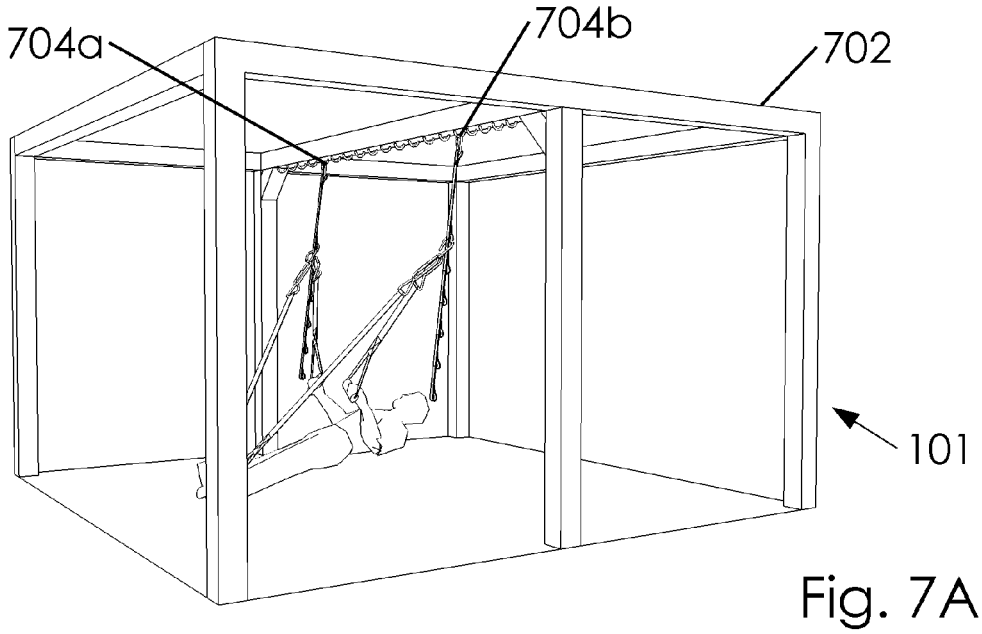
FIGS. 7A and 7B illustrate perspective overviews of said swing system in use as demonstrated by a user.
Figure 7B:
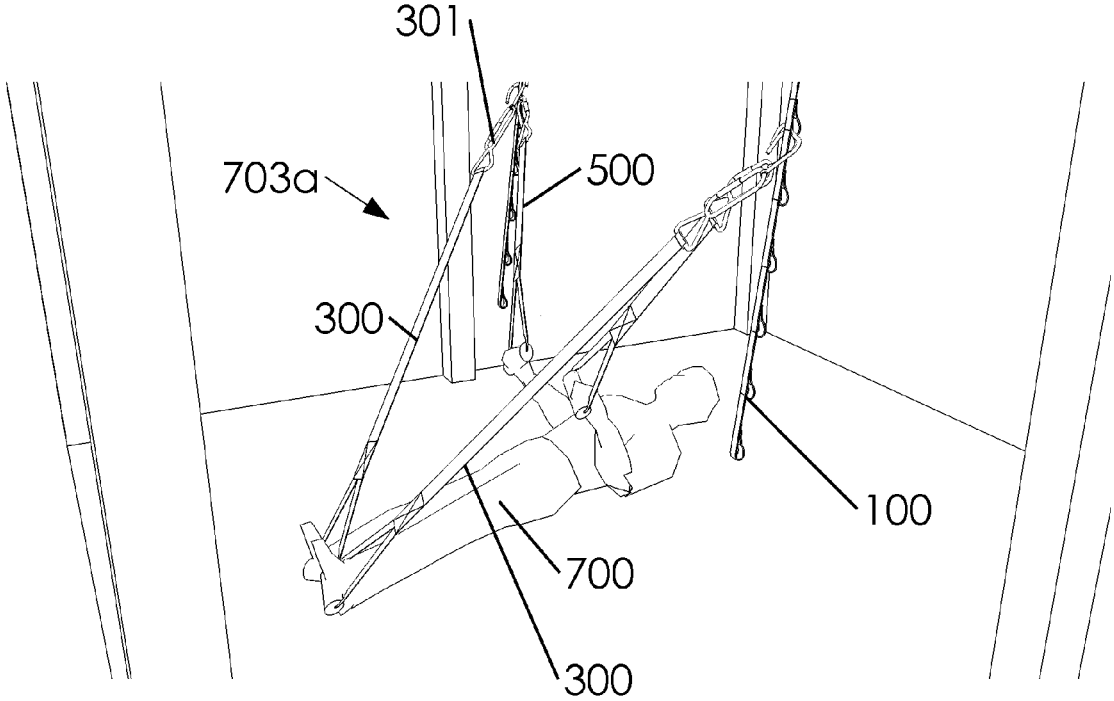
Figure 8A:
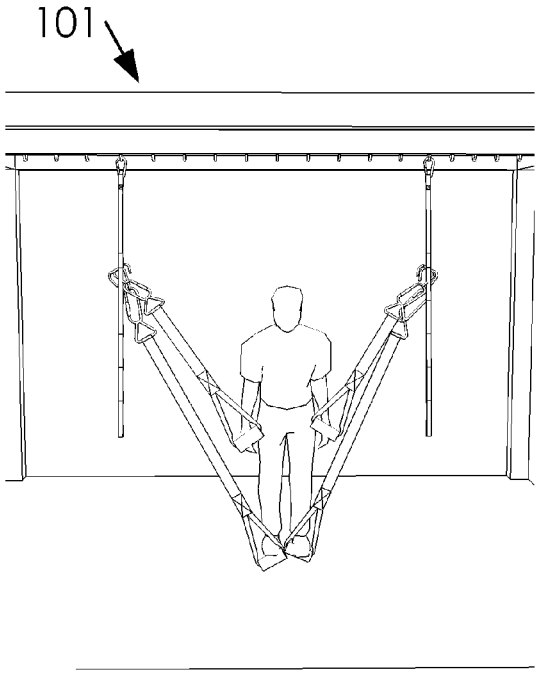
FIGS. 8A, 8B, 8C, and 8D illustrate perspective overviews of said swing system in various configurations which permit said user to mount said swing system in different positions.
Figure 8B:
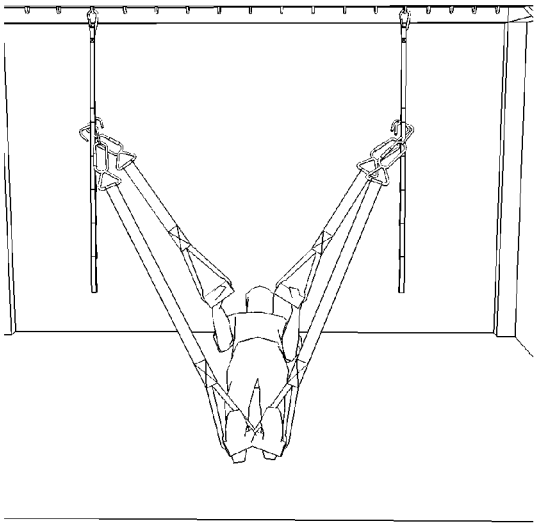
Figure 8C:
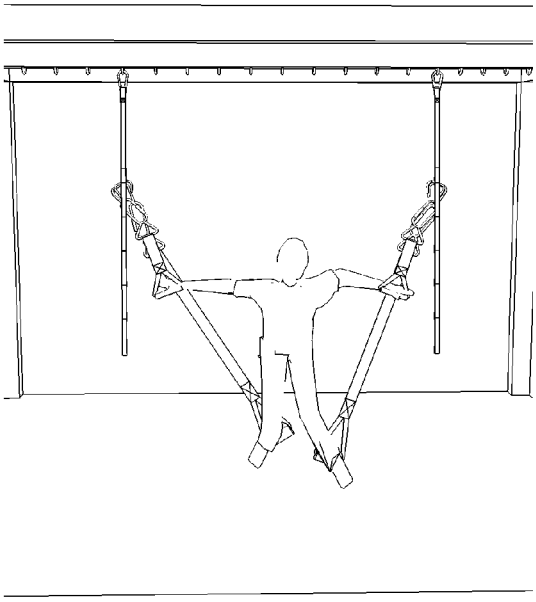
Figure 8D:
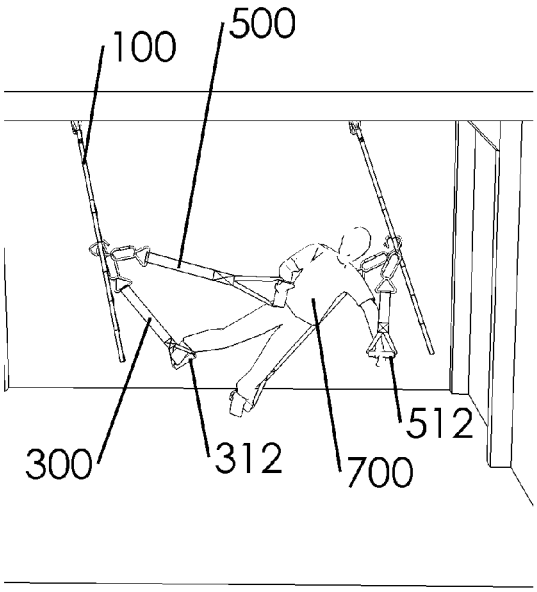

FIGS. 7A and 7B illustrate perspective overviews of said swing system 101 in use as demonstrated by a user 700. In one embodiment, said swing system 101 can comprise a one or more swing assemblies (such as a first swing assembly 703*a*). In one embodiment, each of said one or more swing assemblies can comprise two of said arm strap assembly 500, two of said leg strap assembly 300, two of said hanger strap 100 and a pod 702. In one embodiment, said two of said leg strap assembly 300 and said two of said arm strap assembly 500 can attach to said one or more pockets of said hanger strap 100 by connecting said attachment assembly 301 to said one or more pockets. In one embodiment, said pod 702 can comprise a one or more pod hangers. In one embodiment, said one or more pod hangers can comprise a first hanger 704*a* and a second hanger 704*b*. In one embodiment, said one or more pod hangers can comprise hooks in an upper portion of said pod 702. In one embodiment, said rigger 102 can attach to said one or more pod hangers.

FIGS. 8A, 8B, 8C, and 8D illustrate perspective overviews of said swing system 101 in various configurations which permit said user 700 to mount said swing system 101 in different positions. In one embodiment, said user 700 can be mounted in a substantially vertical position (see FIG. 8A). In one embodiment, said user 700 can be mounted in a substantially horizontal position (see FIG. 8B). In one embodiment, said user 700 can be mounted at an angular or freeform position (see FIG. 8C). In one embodiment, said user 700 can adjust the attachment height of said arm strap assembly 500 and said leg strap assembly 300 on said hanger strap 100 to achieve a desired position (see FIG. 8D). In one embodiment, mounting said swing system 101 can comprise: gripping said hand grip 512 with the hands of said user 700; gripping said foot grip 312 with the feet of said user 700; and suspending from said swing system 101 as demonstrated by said user 700. In one embodiment, using said swing system 101 can comprise: mounting said swing system 101 and then swinging and/or stretching while mounted therein.

Figure 9A:
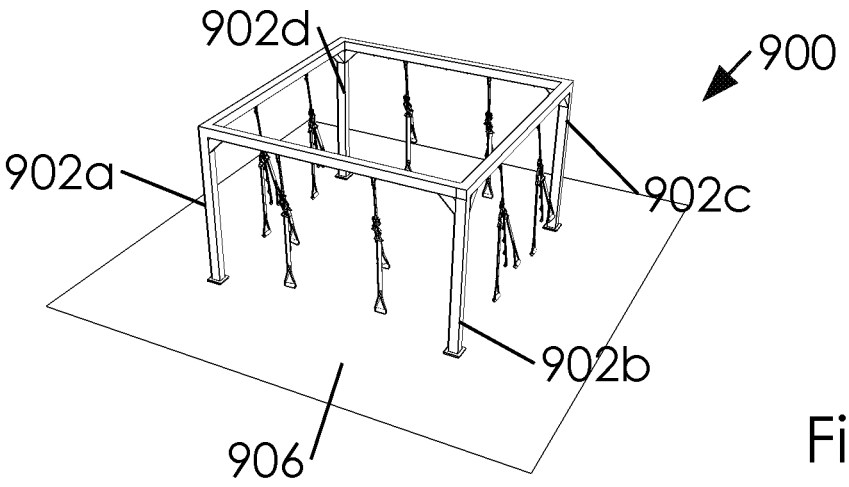
FIGS. 9A, 9B and 9C illustrate a perspective overview, an elevated side view and an elevated top view of a pod of said pod.
Figure 9B:
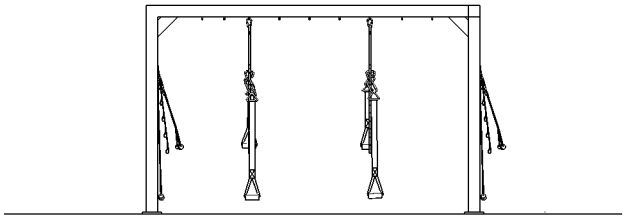
Figure 9C:
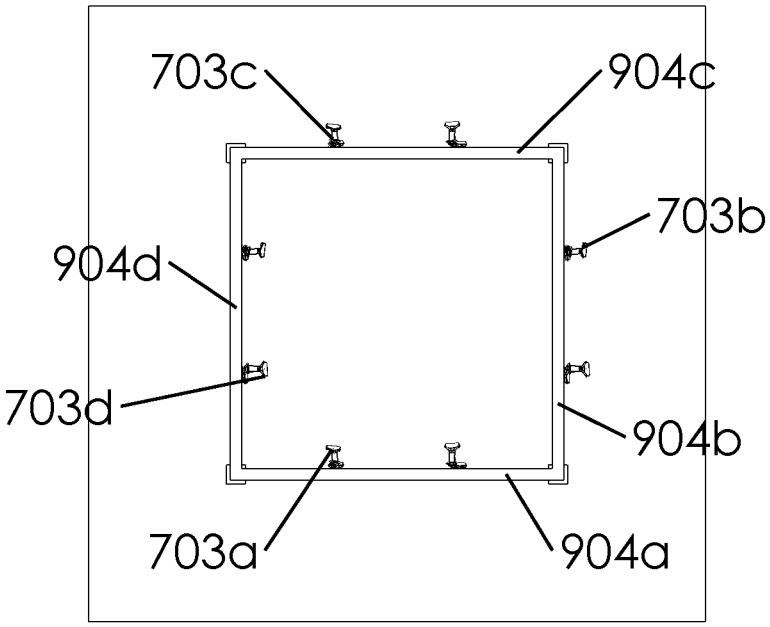

FIGS. 9A, 9B and 9C illustrate a perspective overview, an elevated side view and an elevated top view of a pod 900 of said pod 702. In one embodiment, said pod 900 can comprise a one or more vertical portions, a one or more horizontal portions, said one or more swing assemblies and a mat 906. In one embodiment, said one or more vertical portions can comprise of a first vertical portion 902*a*, a second vertical portion 902*b*, a third vertical portion 902*c* and a fourth vertical portion 902*d*. In one embodiment, said one or more horizontal portions can comprise a first horizontal portion 904*a*, a second horizontal portion 904*b*, a third horizontal portion 904*c* and a fourth horizontal portion 904*d*. In one embodiment, said one or more swing assemblies can comprise said first swing assembly 703*a*, a second swing assembly 703*b*, a third swing assembly 703*c* and a fourth swing assembly 703*d*.

Figure 10:
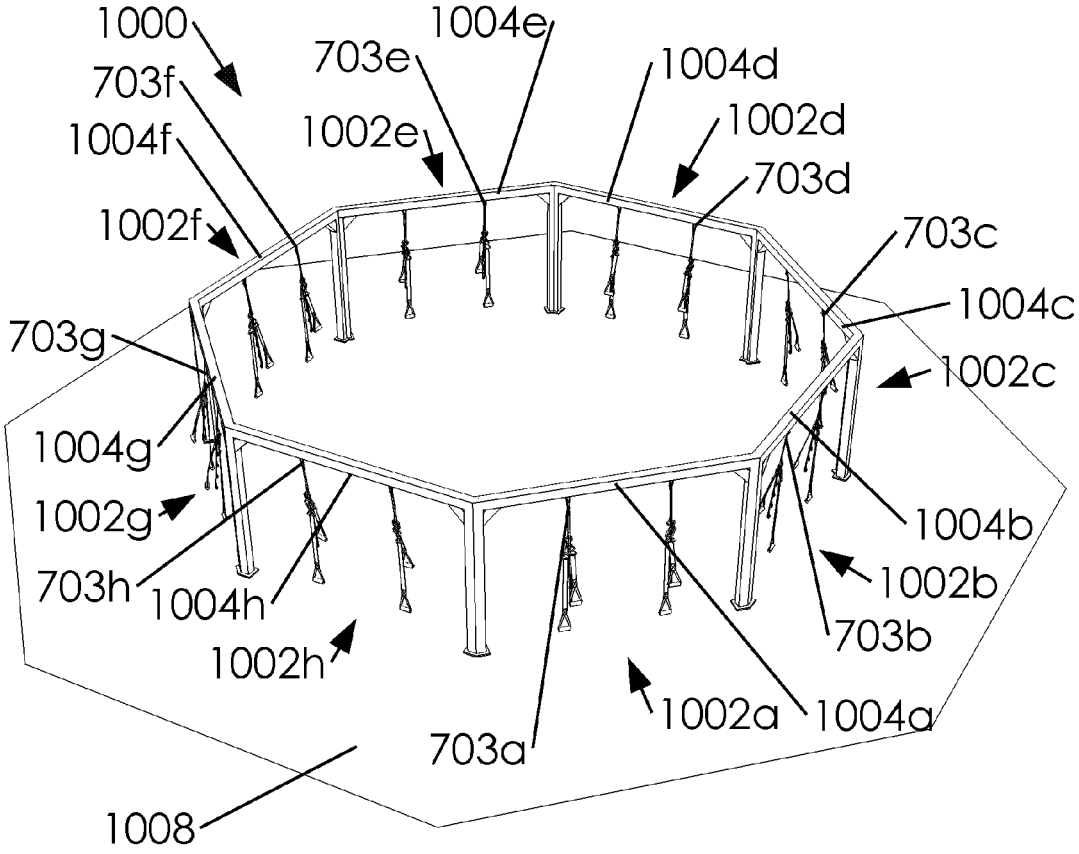
FIG. 10 illustrates a perspective overview of a pod and an alternate of said pod.

FIG. 10 illustrates a perspective overview of a pod 1000 and an alternate of said pod 702. In one embodiment, said pod 1000 can comprise one or more sides, a one or more horizontal portions, a one or more vertical portions, a one or more swing assemblies and a mat 1008. In one embodiment, said one or more sides can comprise a first side 1002*a*, a second side 1002*b*, a third side 1002*c*, a fourth side 1002*d*, a fifth side 1002*e*, a sixth side 1002*f*, a seventh side 1002*g* and an eighth side 1002*h*. In one embodiment, said one or more horizontal portions can comprise a first horizontal portion 1004*a*, a second horizontal portion 1004*b*, a third horizontal portion 1004*c*, a fourth horizontal portion 1004*d*, a fifth horizontal portion 1004*e*, a sixth horizontal portion 1004*f*, a seventh horizontal portion 1004*g* and an eighth horizontal portion 1004*h*. In one embodiment, said one or more vertical portions can comprise a first vertical portion 1006*a*, a second vertical portion 1006*b*, a third vertical portion 1006*c*, a fourth vertical portion 1006*d*, a fifth vertical portion 1006*e*, a sixth vertical portion 1006*f*, a seventh vertical portion 1006*g* and an eighth vertical portion 1006*h*. In one embodiment, said one or more swing assemblies can comprise said first swing assembly 703*a*, said second swing assembly 703*b*, said third swing assembly 703*c*, said fourth swing assembly 703*d*, a fifth swing assembly 703*e*, a sixth swing assembly 703*f*, a seventh swing assembly 703*g* and an eighth swing assembly 703*h*.

Figure 11:
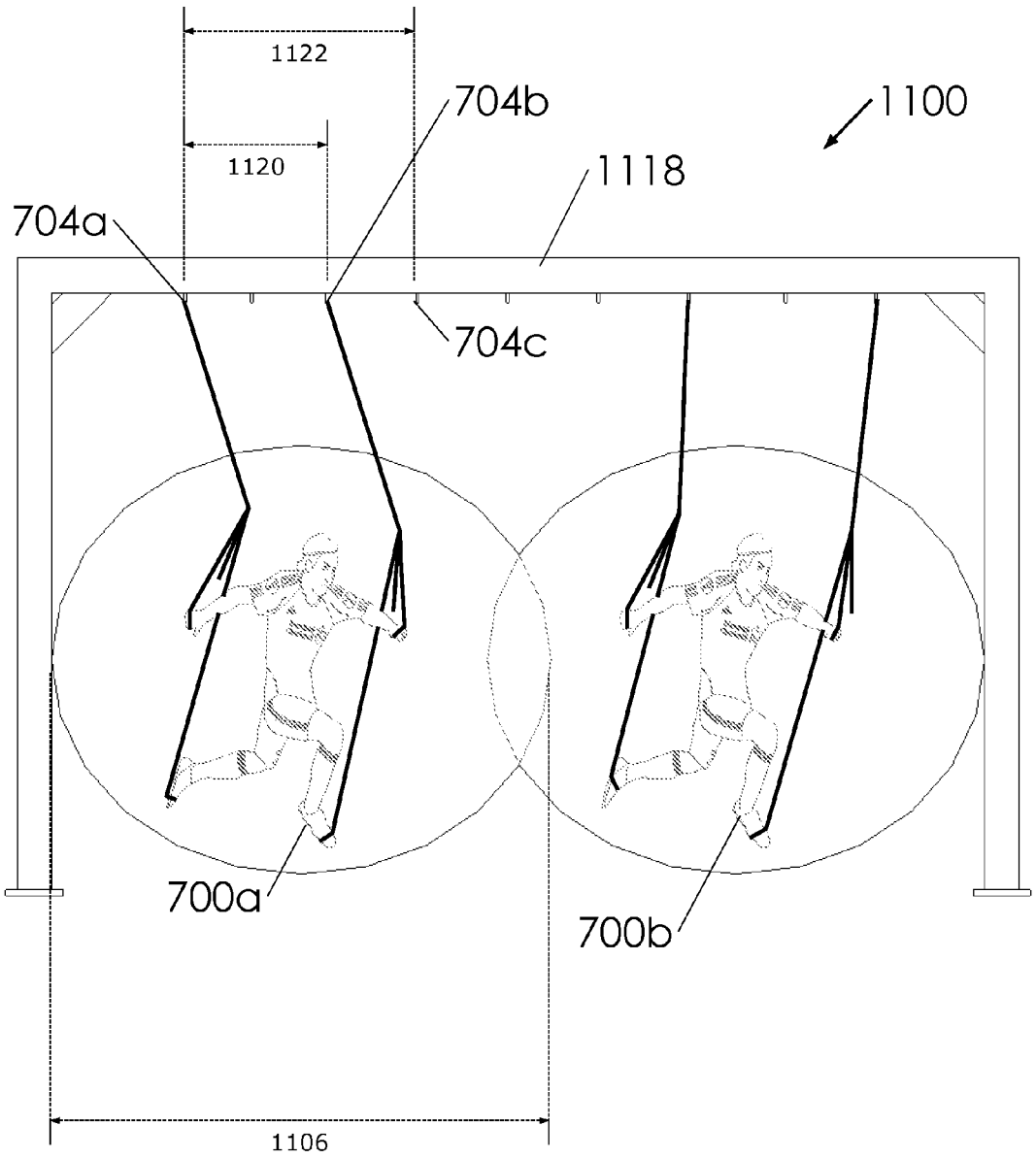
FIG. 11 illustrates an elevated front view of a pod with a first user and a second user using a horizontal portion side-by-side.

FIG. 11 illustrates an elevated front view of a pod 1100 with a first user 700*a* and a second user 700*b* using a horizontal portion 1101 side-by-side. In one embodiment, said swing system 101 can support a plurality of users side-by-side each using one of said horizontal portions of said pod 1100 (such as a horizontal portion 1118). In one embodiment, said first user 700*a* and said second user 700*b* can work together so as to not swing into one another while using said swing system 101. For example, in one embodiment, each of said first user 700*a* and said second user 700*b* can swing laterally within a lateral range 1106; provided they are swinging in a similar pattern relative to one another then collisions can be avoided.

Said horizontal portion 1118 can comprise a plurality of said one or more pod hangers. In one embodiment, said horizontal portion 1118 can comprise a three or more of said one or more pod hangers (as here with said first hanger 704*a*, said second hanger 704*b* and a third hanger 704*c*). In one embodiment, said user 700*a* can arrange a hanger strap set on said pod 1100 at different widths. For example, in one embodiment, attaching to said first hanger 704*a* and said second hanger 704*b* provides a width 1120; whereas, attaching to said first hanger 704*a* and said third hanger 704*c* provides a width 1122. Thus, said two or more hanger strap sets are capable of selectively attaching to said horizontal portion 1118 of said pod 1100 at variable widths. In one embodiment, said variable widths can provide increased or decreased challenges for users of said swing system 101.

Figure 12A:
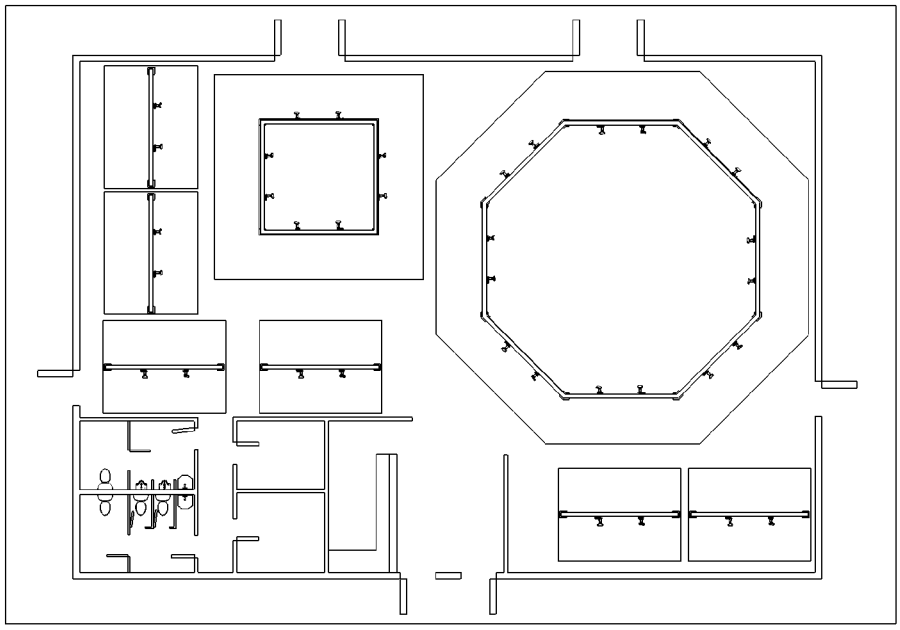
FIGS. 12A and 12B illustrate an elevated top view and a perspective side view of a floor plan.
Figure 12B:
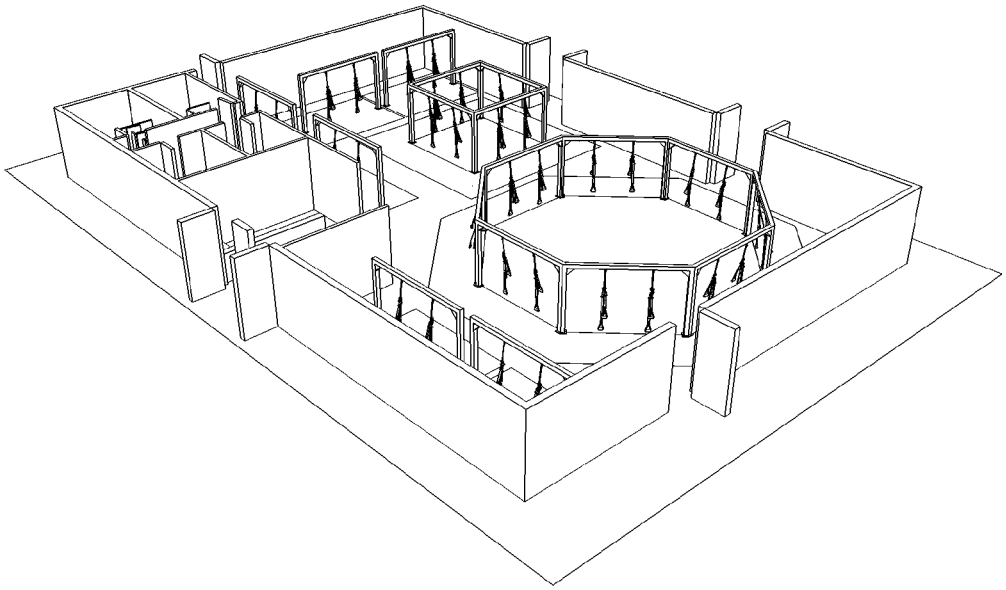

FIGS. 12A and 12B illustrate an elevated top view and a perspective side view of a floor plan 1200. In one embodiment, said swing system 101 can be arranged in a gym space with different pod types and dimensions incorporated into said floor plan 1200 so as to maximize use of said floor space, to facilitate coaching and/or private lessons of persons using said swing system 101.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A swing system comprising:

a pod comprising a one or more vertical portions and a one or more horizontal portions;

a two or more pod hangers attached to said one or more horizontal portions of said pod;

said two or more pod hangers comprising at least a first hanger and a second hanger;

a two or more hanger strap sets attached to a two of said two or more pod hangers;

one of said two or more hanger strap sets comprising a hanger strap having a first end and a second end, a leg strap assembly having a first end and a handle loop at a second end, an arm strap assembly having a first end and a handle loop at a second end, a rigger at a first end of said hanger strap capable of releaseably attaching to one of said two or more pod hangers, said first end of said leg strap assembly attaches to said hanger strap and said first end of said arm strap assembly attaches to said hanger strap;

said leg straps assemblies having a length;

said arm strap assemblies having a length;

said length of said leg strap assemblies being greater than said length of said arm strap assemblies; and said hanger strap comprise a one or more pockets arranged between its said first end and said second end;

said leg strap assemblies and said arm strap assemblies each comprising an attachment assembly at their first end;

said leg strap assemblies and said arm strap assemblies are capable of adjustably attaching to said two or more hanger straps by selectively attaching a one of said arm strap assemblies to one of said one or more pockets with said attachment assembly of said arm strap assemblies and a one of said leg strap assemblies to one of said one or more pockets with said attachment assembly of said leg strap assemblies.

2. A swing system comprising:

a pod;

a two or more pod hangers attached to a portion of said pod;

said two or more pod hangers comprising at least a first hanger and a second hanger;

a two or more hanger strap sets attached to a two of said two or more pod hangers;

a one of said two or more hanger strap sets comprises a leg strap assembly having a first end and a handle loop at a second end, and an arm strap assembly having a first end and a handle loop at a second end;

said one of said two or more hanger strap sets further comprises a hanger strap having a first end and a second end;

said first end of said leg strap assembly attaches to said hanger strap;

said first end of said arm strap assembly attaches to said hanger strap;

said hanger strap comprise a one or more pockets arranged between its said first end and said second end; and wherein, said leg strap assembly and said arm strap assembly attach to said hanger strap at said one or more pockets.

3. The swing system of claim 2 comprising:

said one of said two or more hanger strap sets further comprises a rigger at a first end of said hanger strap releaseably attaching to a one of said two or more pod hangers.

4. The swing system of claim 3 wherein said rigger comprises:

a loop shaped hook comprising a neck, an open portion and a gate;

said neck attaching to a webbing eye of said hanger strap;

said open portion wrapping connecting said neck to said gate; and said gate selectively opening and closing to receive a portion of said one of said two or more pod hangers.

5. The swing system of claim 3 wherein said rigger comprises a rock climbing carabiner.

6. The swing system of claim 2 comprising:

said leg straps assemblies having a length;

said arm strap assemblies having a length; and said length of said leg strap assemblies being greater than said length of said arm strap assemblies.

7. The swing system of claim 2 wherein said handle loop at said second end of said leg strap assemblies comprise:

a webbing portion having a first end and a second end, a foot grip wrapping around said webbing portion, said webbing portion does not twist between its said first end and said second end where said first end of said webbing portion attaches to said second end of said arm strap assemblies, said webbing portion extends through said hand grip without twisting of flipping over, and said second end of said webbing portion attaches to said second end of said arm strap assemblies without twisting of flipping over and a bottom stitch attaching said first end and said second end of said webbing portion to said arm strap assembly.

8. The swing system of claim 2 wherein said handle loop at said second end of said arm strap assemblies comprise:

a webbing portion having a first end and a second end, a hand grip wrapping around said webbing portion, said webbing portion does not twist between its said first end and said second end where said first end of said webbing portion attaches to said second end of said arm strap assemblies, said webbing portion extends through said hand grip without twisting of flipping over, and said second end of said webbing portion attaches to said second end of said arm strap assemblies without twisting of flipping over and a bottom stitch attaching said first end and said second end of said webbing portion to said arm strap assembly.

9. The swing system of claim 2 wherein said pod comprising a one or more horizontal portions;

each of said one or more horizontal portions of said pod comprise three or more of said two or more pod hangers; and said two or more hanger strap sets selectively attach to said horizontal portions of said pod at variable widths.

10. The swing system of claim 2 wherein said pod comprising a one or more vertical portions and a one or more horizontal portions;

said one or more horizontal portions are substantially horizontal and arranged above said two or more pod hangers; and said two or more pod hangers are attached to said one or more horizontal portions of said pod.

11. A method of using a swing system comprising:

attaching a hanger strap set to a two of a two or more pod hangers of a pod;

inserting a one or more feet of a user into a one or more leg straps of said hanger strap sets;

inserting a one or more hands of said user into a one or more arm straps of said hanger strap sets;

supporting a weight of said user with said pod by suspending a portion of said weight of said user from a one or more horizontal portions of said pod, attaching said one or more horizontal portions of said pod to a first end of a one or more vertical portions of said pod, and attaching a second end of a one or more vertical portions of said pod to a ground surface below said user of said pod;

swinging said user in said hanger strap set; wherein, said two or more pod hangers comprising at least a first hanger and a second hanger;

a two or more hanger strap sets attached to a two of said two or more pod hangers;

a one of said two or more hanger strap sets comprises a leg strap assembly having a first end and a handle loop at a second end, and an arm strap assembly having a first end and a handle loop at a second end;

said one of said two or more hanger strap sets further comprises a hanger strap having a first end and a second end;

said first end of said leg strap assembly attaches to said hanger strap;

said first end of said arm strap assembly attaches to said hanger strap;

said hanger strap comprise a one or more pockets arranged between its said first end and said second end; and wherein, said leg strap assembly and said arm strap assembly attach to said hanger strap at said one or more pockets.

12. The method of using a swing system of claim 11 wherein attaching said hanger strap set to a two of a two or more pod hangers of a pod comprises releaseably attaching a rigger at a first end of said hanger strap to a one of said two or more pod hangers.

13. The method of using a swing system of claim 11 wherein supporting a weight of said user with said pod further comprise:

attaching a first end of a leg strap assembly to a hanger strap of said hanger strap set, attaching said hanger strap to said horizontal portion of said pod, and supporting said one or more feet of said user with said leg strap assembly.

14. The method of using a swing system of claim 11 wherein supporting a weight of said user with said pod further comprise:

attaching a first end of a arm strap assembly to a hanger strap of said hanger strap set, attaching said hanger strap to said horizontal portion of said pod, and supporting said one or more hands of said user with said leg strap assembly.

15. The method of using a swing system of claim 11 wherein supporting a weight of said user with said pod further comprise:

attaching a first end of a leg strap assembly to a hanger strap of said hanger strap set, attaching a first end of an arm strap assembly to said hanger strap of said hanger strap set, attaching said hanger strap to said horizontal portion of said pod, supporting said one or more feet of said user with said leg strap assembly, and supporting said one or more hands of said user with said arm strap assembly.

16. A swing system comprising:

a pod;

a two or more pod hangers attached to a portion of said pod;

said two or more pod hangers comprising at least a first hanger and a second hanger;

a two or more hanger strap sets attached to a two of said two or more pod hangers;

a one of said two or more hanger strap sets comprises a leg strap assembly having a first end and a handle loop at a second end, and an arm strap assembly having a first end and a handle loop at a second end;

said one of said two or more hanger strap sets further comprises a hanger strap having a first end and a second end;

said first end of said leg strap assembly attaches to said hanger strap;

said first end of said arm strap assembly attaches to said hanger strap;

said hanger strap comprise a one or more pockets arranged between its said first end and said second end; and wherein, said leg strap assemblies and said arm strap assemblies each comprising an attachment assembly at their first end;

said leg strap assemblies and said arm strap assemblies adjustably attaching to said two or more hanger straps by selectively attaching a one of said arm strap assemblies to one of said one or more pockets with said attachment assembly of said arm strap assemblies and a one of said leg strap assemblies to one of said one or more pockets with said attachment assembly of said leg strap assemblies.

17. The swing system of claim 16 wherein:

said attachment assembly comprise a triangle loop, a quick release and a hook;

said triangle loop attach to said first ends of said leg strap assemblies and said arm strap assemblies;

said quick release selectively attaching to said hook and said triangle loop; and said hook selectively attaching to one of said one or more pockets.

18. A swing system comprising:

a pod;

a two or more pod hangers attached to a portion of said pod;

said two or more pod hangers comprising at least a first hanger and a second hanger;

a two or more hanger strap sets attached to a two of said two or more pod hangers;

a one of said two or more hanger strap sets comprises a leg strap assembly having a first end and a handle loop at a second end, and an arm strap assembly having a first end and a handle loop at a second end;

said handle loop at said second end of said arm strap and/or said leg strap assemblies comprise:

a webbing portion having a first end and a second end, a hand grip wrapping around said webbing portion, said webbing portion does not twist between its said first end and said second end where said first end of said webbing portion attaches to said second end of said arm strap assemblies, said webbing portion extends through said hand grip without twisting of flipping over, and said second end of said webbing portion attaches to said second end of said arm strap assemblies without twisting of flipping over; and a bottom stitch attaching said first end and said second end of said webbing portion to said arm strap assembly.

19. A swing system comprising:

a pod comprising a one or more horizontal portions;

a two or more pod hangers attached to said one or more horizontal portions of said pod;

said two or more pod hangers comprising at least a first hanger and a second hanger;

a two or more hanger strap sets attached to a two of said two or more pod hangers;

a one of said two or more hanger strap sets comprises a leg strap assembly having a first end and a handle loop at a second end, and an arm strap assembly having a first end and a handle loop at a second end;

each of said horizontal portions of said pod comprise three or more of said two or more pod hangers; and said two or more hanger strap sets selectively attach to said horizontal portions of said pod at variable widths.

* * * * *